US010422161B2

(12) United States Patent
Connan

(10) Patent No.: US 10,422,161 B2
(45) Date of Patent: Sep. 24, 2019

(54) MAGNETIC LOCK MECHANISM

(71) Applicant: Hamish Connan, Marrickville Metro (AU)

(72) Inventor: Hamish Connan, Marrickville Metro (AU)

( * ) Notice: Subject to any disclaimer, the term of this patent is extended or adjusted under 35 U.S.C. 154(b) by 0 days.

(21) Appl. No.: 15/574,095

(22) PCT Filed: May 20, 2016

(86) PCT No.: PCT/AU2016/050391
§ 371 (c)(1),
(2) Date: Nov. 14, 2017

(87) PCT Pub. No.: WO2016/183640
PCT Pub. Date: Nov. 24, 2016

(65) Prior Publication Data

US 2018/0298643 A1 Oct. 18, 2018

(30) Foreign Application Priority Data

May 20, 2015 (AU) ..... 2015901832

(51) Int. Cl.
*E05B 47/00* (2006.01)
*E05C 3/04* (2006.01)
(Continued)

(52) U.S. Cl.
CPC ..... *E05B 47/0038* (2013.01); *E05B 15/1635* (2013.01); *E05B 19/0052* (2013.01);
(Continued)

(58) Field of Classification Search
CPC .. E05C 3/042; E05B 47/0038; E05B 15/1635; E05B 19/0052; E05B 47/0045;
(Continued)

(56) References Cited

U.S. PATENT DOCUMENTS 3,602,020 A 8/1971 Kajita
3,695,073 A 10/1972 Prescott
(Continued)

FOREIGN PATENT DOCUMENTS

CN 202031391 U 11/2011
DE 23 53 407 A1 4/1975
(Continued)

OTHER PUBLICATIONS

International Search Report corresponding to PCT/AU2016/050391, dated Aug. 24, 2016, 5 pages.
(Continued)

*Primary Examiner* — Lloyd A Gall
(74) *Attorney, Agent, or Firm* — Lewis Roca Rothgerber Christie LLP

(57) ABSTRACT

A magnetic lock has a barrel and keyway, the barrel when rotated unlocking the lock. Locking element cavities each contain a moveable locking element such as a ball, movable in response to a magnetic field applied by a magnetic key. A locking bar is movable between a locked position and an unlocked position. The locking bar has coded projections which extend into the respective locking element cavities when the locking bar moves from the locked position to the unlocked position. A code plate is shaped in registration with the coded projections. When the locking bar is in the locked position the code plate and the coded projections form a substantially uninterrupted surface. The locking elements prevent movement of the locking bar from the locked position to the unlocked position except when magnetically moved to a coded position.

13 Claims, 10 Drawing Sheets

(51) Int. Cl.
*E05B 15/16* (2006.01)
*E05B 19/00* (2006.01)

(52) U.S. Cl.
CPC ..... *E05B 47/0044* (2013.01); *E05B 47/0045* (2013.01); *E05C 3/042* (2013.01)

(58) Field of Classification Search
CPC ..... E05B 47/0044; E05B 47/0041; E05B 47/0042; E05B 47/0043
USPC ..... 70/276, 413, 495, 496; 292/251.5
See application file for complete search history.

(56) References Cited

U.S. PATENT DOCUMENTS

| | | | | | |
|---|---|---|---|---|---|
| 3,834,197 | A | * | 9/1974 | Sedley | E05B 47/0043 292/341.17 |
| 3,928,992 | A | | 12/1975 | Talbot | |
| 3,935,720 | A | | 2/1976 | Böving | |
| 3,942,345 | A | | 3/1976 | Sasahara | |
| 4,077,242 | A | * | 3/1978 | Sedley | E05B 47/0043 70/413 |
| 4,084,416 | A | | 4/1978 | Prunbauer | |
| 4,127,017 | A | | 11/1978 | Perkut | |
| 4,228,667 | A | | 10/1980 | Herriott | |
| 4,253,320 | A | * | 3/1981 | Schwab | E05B 47/0042 70/276 |
| 4,312,198 | A | | 1/1982 | Sedley | |
| 4,392,134 | A | | 7/1983 | Lutz | |
| 4,416,127 | A | * | 11/1983 | Gomez-Olea Naveda | G07C 9/0073 70/276 |
| 4,516,416 | A | | 5/1985 | Prunbauer et al. | |
| 4,562,711 | A | * | 1/1986 | Fliege | G07C 9/00738 70/276 |
| 4,662,197 | A | | 5/1987 | Tietz et al. | |
| 4,686,841 | A | | 8/1987 | Prunbauer et al. | |
| 4,718,261 | A | | 1/1988 | Kunz | |
| 5,513,507 | A | * | 5/1996 | Merchel | E05B 35/002 235/382 |
| 5,839,307 | A | | 11/1998 | Field et al. | |
| 6,799,447 | B2 | | 10/2004 | Mielonen et al. | |
| 7,694,542 | B2 | | 4/2010 | Loughlin et al. | |
| 2002/0189306 | A1 | | 12/2002 | Tsai | |
| 2009/0090149 | A1 | | 4/2009 | Fox | |
| 2010/0050715 | A1 | | 3/2010 | Hu et al. | |

FOREIGN PATENT DOCUMENTS

| | | | | |
|---|---|---|---|---|
| DE | 24 05 580 | B1 | | 7/1975 |
| DE | 24 13 555 | A1 | | 10/1975 |
| DE | 25 58 249 | A1 | | 7/1977 |
| DE | 26 44 367 | A1 | | 4/1978 |
| EP | 0 633 375 | A1 | | 1/1995 |
| FR | 2 305 578 | A1 | | 10/1976 |
| FR | 2 687 426 | A1 | | 8/1993 |
| WO | WO 91/05931 | | * | 5/1991 |

OTHER PUBLICATIONS

EVVA MCS, 3 pages from Lockwiki: http://www.lockwiki.com/index.php/EVVA_MCS.
Abloy Protec, 3 pages from Lockwiki: http://www.lockwiki.com/index.php/Abloy_Protec.
Supplementary European Search Report dated Nov. 30, 2018 regarding European Patent Application No. 16795564.0 corresponding to U.S. Appl. No. 15/574,095 (7 pages).

* cited by examiner

MAGNETIC LOCK MECHANISM

CROSS-REFERENCE TO RELATED APPLICATIONS

This application is a National Phase Patent Application and claims priority to and the benefit of International Application Number PCT/AU2016/050391, filed on May 20, 2016, which claims priority to Australian Provisional Patent Application No. 2015901832, filed on May 20, 2015, the entire contents of all of which are incorporated herein by reference.

TECHNICAL FIELD

The present invention relates to key operable lock mechanisms, and in particular relates to a lock mechanism in which the key interacts magnetically with magnetic locking elements.

BACKGROUND OF THE INVENTION

Key operable locks are widely used to control latches or padlocks intended for use on doors, windows, hatches and other movable members adapted to close an access opening. Key operable locks comprise a keyway into which a key may be inserted, and a barrel which when rotated effects unlocking of the lock to release a latch or bolt or the like. Rotation of the barrel is possible only if the key, when inserted into the keyway, aligns with locking elements of the lock. However, locks that rely on mechanical interaction between the key and the locking elements can be physically felt or manipulated, so that by inserting a lock picking tool or such instruments into the keyway the locking elements can be picked or decoded, compromising security.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this specification, a statement that an element may be "at least one of" a list of options is to be understood that the element may be any one of the listed options, or may be any combination of two or more of the listed options.

SUMMARY OF THE INVENTION

According to a first aspect the present invention provides a lock comprising:

a barrel defining a keyway, the barrel when rotated unlocking the lock;

a plurality of locking element cavities each containing a locking element which is free to move within the respective locking element cavity, and each locking element being movable in response to a respective local magnetic field applied by a magnetic key when positioned within the keyway, whereby the locking element may take any one of a number of positions within the respective locking element cavity and when in one position the locking element vacates other possible positions;

a locking bar movable between a first locking bar position in which rotation of the barrel is obstructed by the locking bar, and a second locking bar position in which the barrel is free to rotate, the locking bar comprising coded projections which extend into the respective locking element cavities when the locking bar moves from the first locking bar position to the second locking bar position; and a code plate shaped in registration with the coded projections of the locking bar such that when the locking bar is in the first locking bar position the code plate and the coded projections of the locking bar form a substantially uninterrupted surface;

wherein the locking elements prevent movement of the locking bar from the first locking bar position to the second locking bar position except when each locking element has been magnetically moved to a coded position within the respective locking element cavity.

According to a second aspect the present invention provides a method of operating a lock, the method comprising:

inserting a magnetic key into a keyway defined by a barrel;

the key applying respective local magnetic fields to a plurality of respective locking elements so as to move each locking element to a coded position within a respective locking element cavity, whereby the locking element may take any one of a number of positions within the respective locking element cavity and when in one position the locking element vacates other possible positions; and applying a rotational force to the key in order to apply a radial force to a locking bar, to move the locking bar from a first locking bar position in which rotation of the barrel is obstructed by the locking bar and in which a code plate shaped in registration with the coded projections of the locking bar and the coded projections of the locking bar form a substantially uninterrupted surface, to a second locking bar position in which the barrel is free to rotate, whereby in the second locking bar position coded projections of the locking bar extend into the respective locking element cavities.

According to a third aspect the present invention provides a non-transitory computer readable medium for producing a lock, comprising instructions making up a digital blueprint file which, when executed by one or more processors, causes performance of the following:

three-dimensional printing of a barrel defining a keyway, the barrel when rotated unlocking the lock;

three-dimensional printing of a plurality of locking element cavities each configured to contain a locking element which is free to move within the respective locking element cavity, and each locking element being movable in response to a respective local magnetic field applied by a magnetic key when positioned within the keyway, whereby the locking element may take any one of a number of positions within the respective locking element cavity and when in one position the locking element vacates other possible positions;

three-dimensional printing of a locking bar movable between a first locking bar position in which rotation of the barrel is obstructed by the locking bar, and a second locking bar position in which the barrel is free to rotate, the locking bar comprising coded projections which extend into the respective locking element cavities when the locking bar moves from the first locking bar position to the second locking bar position; and three-dimensional printing of a code plate shaped in registration with the coded projections of the locking bar such that when the locking bar is in the first locking bar position the code plate and the coded projections of the locking bar form a substantially uninterrupted surface;

wherein the locking elements prevent movement of the locking bar from the first locking bar position to the second locking bar position except when each locking element has been magnetically moved to a coded position within the respective locking element cavity.

According to a fourth aspect the present invention provides a magnetic key for unlocking a magnetic lock, the magnetic key comprising a plurality of magnets for producing respective local magnetic fields, the magnets positioned upon the key in a manner that when the key is positioned in the keyway of a magnetic lock the magnets urge magnetic locking elements of the lock to coded positions, whereby the locking element may take any one of a number of coded positions within the respective locking element cavity and when in one position the locking element vacates all other possible positions, and whereby the locking elements permit movement of a locking bar to an unlocked position only when in the respective coded positions.

In some embodiments each locking element may comprise a magnetic ball, magnetic disc, magnetic hexagonal tile, or the like.

In some embodiments, a plurality of locking bars may be provided circumferentially about an axis of the barrel, whereby all locking elements must be unlocked and moved radially inward in order to unlock the lock, thereby increasing a number of lock and key combinations which may be effected and thus increasing security of the lock.

In some embodiments of the invention, rotation of the barrel may be obstructed by the locking bar while in the first locking bar position by a protrusion of the locking bar engaging in a respective recess positioned in a lock element radially outwards of the locking bar, whereby radially inward movement of the locking bar permits disengagement of the protrusion from the recess. In such embodiments, a radially inward force may be generated upon the locking bar by providing an angled face upon the locking bar protrusion, configured to produce a radial force from a rotational force.

The locking element cavities may in some embodiments comprise a substantially triangular shape, defining three or six possible coded positions of the locking element. Additionally or alternatively, some or all of the locking element cavities may take any other suitable shape such as a substantially square, hexagonal or circular shape, defining any suitable number of possible coded positions of the locking element.

In preferred embodiments of the invention, a code plate is provided between the locking bar and the barrel, the code plate comprising cavities for the locking bar projections to pass through, the cavities of the code plate are preferably matched to the shape of the locking bar projections so that in the first locking bar position the code plate and the radially inner surface of the locking plate projections together present a substantially uninterrupted surface, such as a planar surface, to the locking elements. Such embodiments may assist in minimising the possibility of the lock being picked or decoded by picking tools or such instruments which may be exacerbated if discernible discontinuities arise in the surface presented by the code plate and the radially inner surface of the locking bar projections. Providing the code plate thus ensures that the balls do not naturally, or unnaturally, settle into the coded position either through vibration or manipulation.

The code plate provided as a part of the present invention may be particularly useful for utilisation in a magnetic lock, which may otherwise utilise movable members to limit entry of the locking elements into the cavities of the locking projections except when each locking element has been moved, magnetically or otherwise, to a coded position within the respective locking element cavity, and which is further appropriate for use in cylinder locks due to size constraints, manufacturing/assembly complexity and potential failure of moving parts in past designs.

In some embodiments the locking bar projections are preferably shaped so as to align with and substantially completely occupy the locking element cavities when in the second locking bar position, except in respect of the coded position within each locking element cavity which is never occupied by the locking bar projections.

In preferred embodiments of the invention the magnets provided in the magnetic key possess the minimum magnetic fields required to ensure the respective locking elements are able to take any of the coded positions within the respective locking element cavity, the magnetic field strength being controlled by, or by a combination of, factors such as magnet length, radius, material or grade, and being constructed of a magnetic material with a high maximum operating temperature, high coercivity and low susceptibility to corrosion, such as samarium cobalt. Such embodiments recognise that the cavities may be oriented such that in order take a coded position the magnets may be required to attract the locking elements upwards, against gravity, from the lowest to the highest part of such cavities.

In preferred embodiments of the invention there are five locking element cavities provided in respect of each of two locking bars located on either side of the barrel defining the keyway, with each cavity comprising six coded positions for the respective locking element. Such embodiments permit approximately sixty million permutations. Additionally or alternatively, the locking element cavities may be provided in any orientation or arrangement on the barrel including being slightly offset in position, hence increasing the number of possible key combinations within the space provided by the barrel.

In some embodiments of the invention the number of possible coded positions within a single locking element cavity may be increased, for example from a substantially triangular shaped cavity with a three positions-per-side having six coded positions, to five positions-per-side permitting twelve or fifteen coded positions per cavity, depending on the arrangement. In such embodiments the adoption of a finer position resolution could be assisted by the inclusion of dimple-like structures on the locking bar projection to ensure the locking elements are maintained in their coded position.

In some embodiments master keying may be effected by providing more than one ball pocket in each locking bar coded projection.

In some embodiments the key may be provided in two pieces, with magnets located on the inside, to be subsequently joined in order to conceal the location of magnets. In this manner such embodiments may utilise a coating to conceal the location of the magnets.

In some embodiments the or each locking bar may be produced in more than one piece and/or composed of more than one material. The coded projections may in some embodiments be composed of polyoxymethylene, or similar material, to frustrate radiographic decoding attacks.

BRIEF DESCRIPTION OF THE DRAWINGS

An example of the invention will now be described with reference to the accompanying drawings, in which.

DESCRIPTION OF THE PREFERRED EMBODIMENTS

Figure 1:
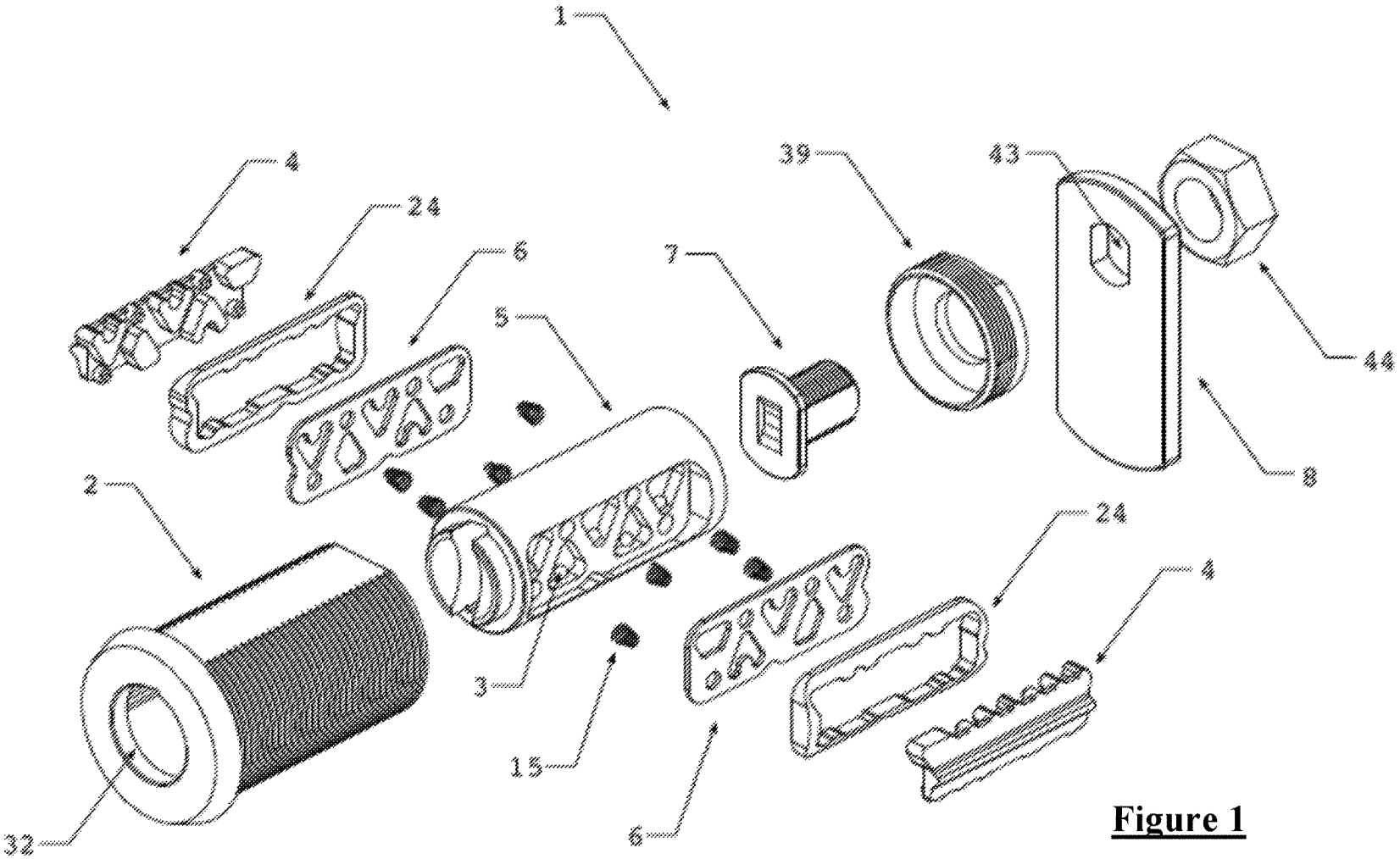
FIG. 1 schematically depicts a magnetic cylinder lock in accordance with one embodiment of the invention.

In FIG. 1, in accordance with one embodiment of the present invention, there is schematically depicted a magnetic cylinder lock 1 which may comprise a casing 2 adapted to house a series of magnetically susceptible steel balls 3 and locking bars 4. The magnetic lock 1 also comprises a barrel 5, code plate 6, end plug 7 and a latch 8.

Figure 2:
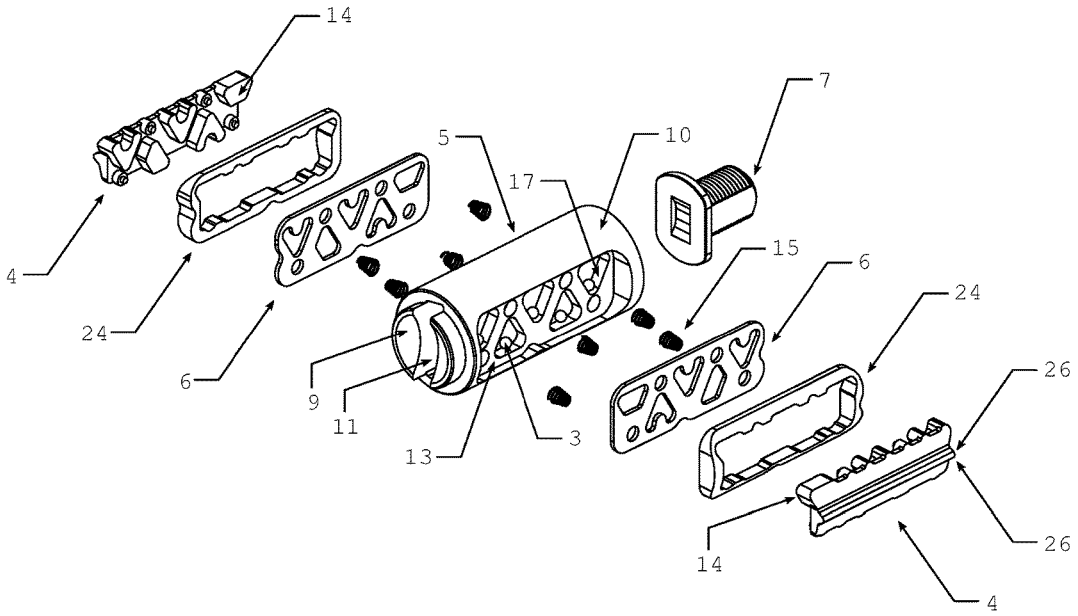
FIG. 2 is an enlarged view of a portion of FIG. 1.

As shown in FIG. 2, an enlarged view of a portion of FIG. 1, the barrel 5 comprises a generally cylindrical front projection 9 and body 10, the front projection 9 being of a smaller diameter than the body 10. The front of the lock refers herein to the face presented to receive a key when the lock is installed in a door or the like. Formed in and defined by the barrel 5 is a keyway 11 that extends longitudinally inwards from the front projection 9 to the rear end face 12 (shown in FIG. 6). The keyway 11 has a configuration adapted to receive a key of the type shown in FIG. 5, however, it may include features that limit entry to keys which are shaped properly, or which incorporate features corresponding to the keyway's features. By providing a keyway 11 that requires adherence to a unique geometry the variety of key configurations available is expanded, however in the context of the present invention this is also important in ensuring that only a correctly orientated key can be inserted.

Figure 6:
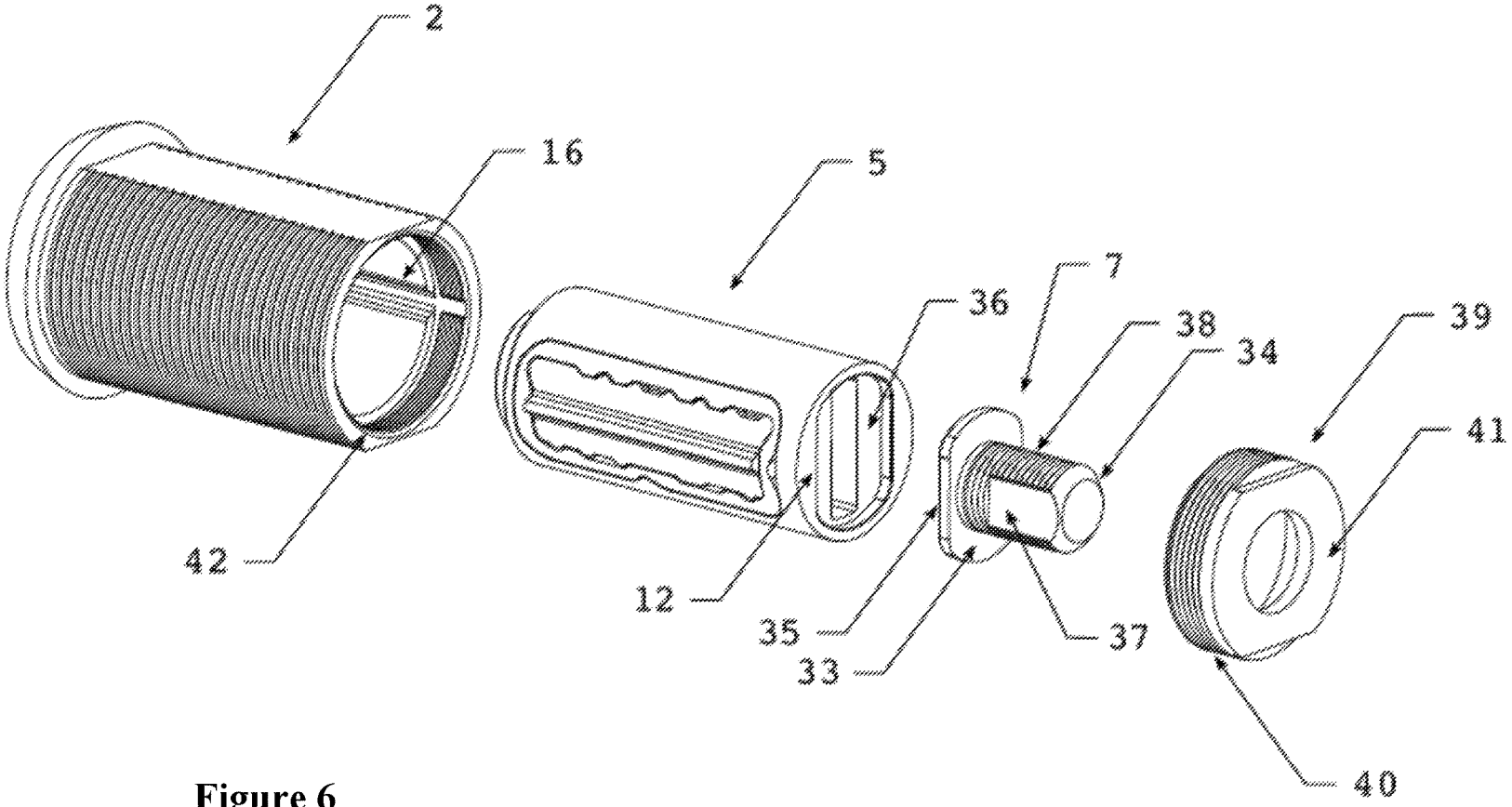
FIG. 6 is an exploded view of the lock barrel, casing, end plug and end cap in accordance with the embodiment of FIGS. 1-5.

Extending inwardly from the outer cylindrical periphery of the body 10 are two longitudinally extending recesses 13 which are adapted to receive locking bars 4 which have coded projections 14. The locking bars 4 are biased to a radially outer position by means of springs 15, being in a radial direction relative to the cylindrical nature of barrel 5. The locking bars 4 are slidably received within the recesses 13 so as to be movable from a radially inner position allowing rotation of the barrel 5 to a radially outer position engaged within grooves 16 formed on the internal surfaces of the casing 2, as shown in FIG. 6. When the locking bar 4 is in this radially outward position the barrel 5 is prevented from rotating by the locking bars 4 being engaged within the grooves 16.

Each of the longitudinally extending recesses 13 is provided with a number of cavities 17 associated with magnetically susceptible steel balls 3, the number of cavities varying depending on the desired security level of the magnetic lock. It is to be appreciated that whilst the cavity 17 shown in FIG. 2 is preferably triangular it is not limited as such to any particular geometric shape. The balls 3 are maintained in the cavities 17 by a code plate 6 that is dimensioned to receive the coded projections 14, such that when the locking bar 4 is in a radially outer position the code plate 6 and coded projections 14 form a substantially planar uninterrupted surface. This arrangement is an important feature of the present embodiment as it enables the balls 3 to freely locate to any position within the cavity 17 whilst negating accidental, or deliberate, manipulation of the balls into the coded projections' 14 ball pockets 18, 19 as discussed in the following.

Figure 3:
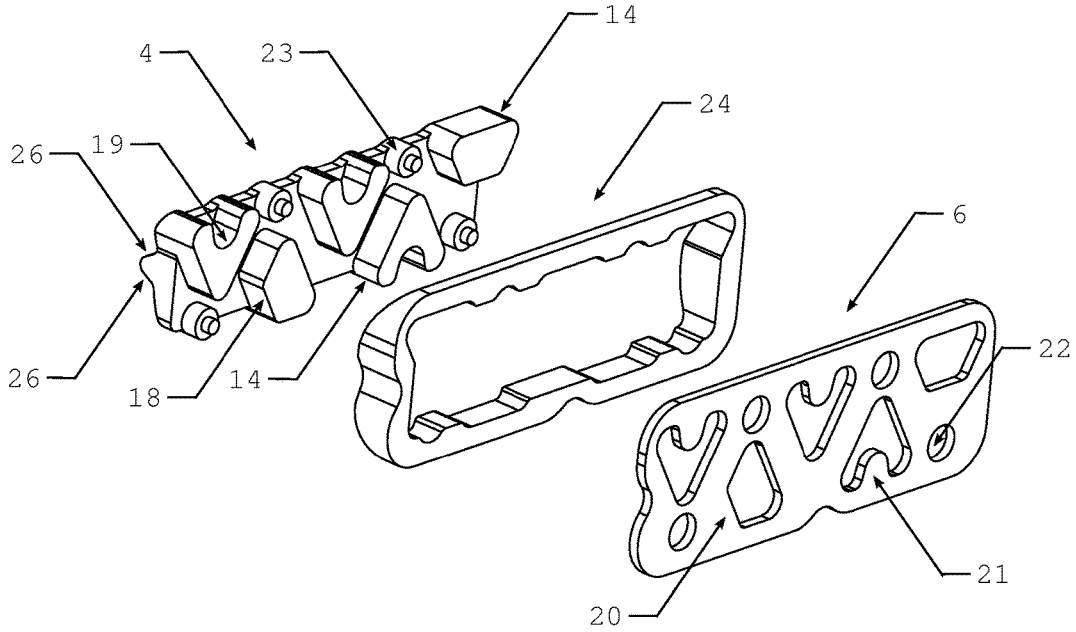
FIG. 3 is an exploded view of the locking bar, keeper plate and code plate in the embodiment of FIGS. 1 and 2.

As shown in FIG. 3 the code plate 6 includes a number of corner 20 and side 21 encoded triangular passages, sized and shaped in registration with the coded projections 14 extending from the locking bar 4. The matching shape of the coded projections 14 and the coded passages 20, 21 in the code plate 6 permits the coded projections 14 to enter the cavities 17 upon assembly of the magnetic lock. The code plate 6 is also provided with spring passages 22 which correspond to circular spring extensions 23 on the locking bar 4, the extensions 23 being of a smaller diameter than the passages 22. The code plate 6 is held within the recess 13 of the barrel 5 by means of a plate keeper 24 which is constrained between the code plate 6 and the curved internal surface of the case 2. The keeper plate 24 is internally sized and shaped in registration with the outline of the locking bar 4, and as such, does not impede radial movement of the locking bar 4.

Figure 4:
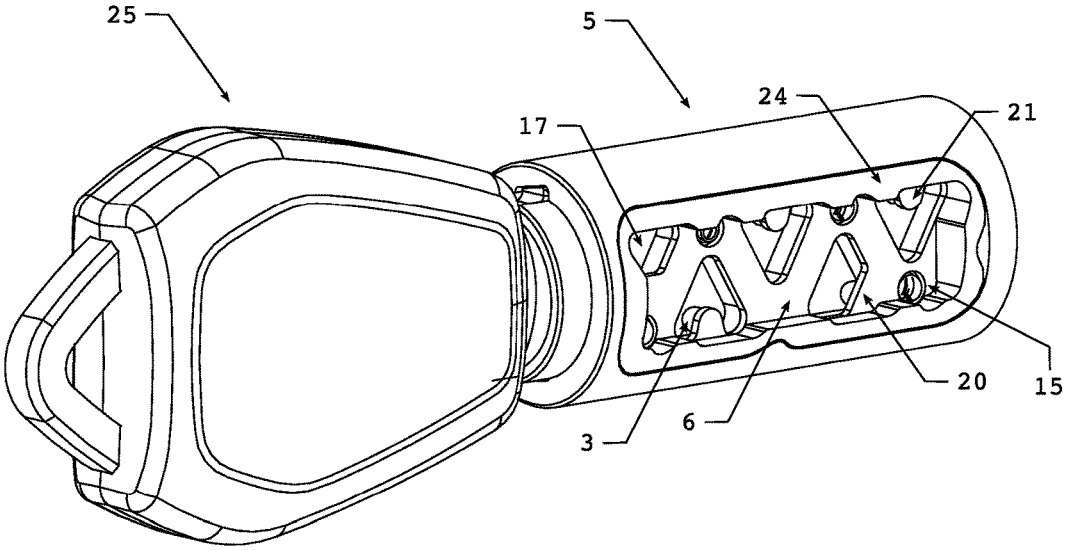
FIG. 4 illustrates interaction of a key with the lock of FIGS. 1-3.

As shown in FIG. 4, upon a key 25 of correct configuration being inserted in the keyway 11, each of the balls 3 is magnetically urged to a respective position which is precisely located behind the code plates 6 such that the coded projections 14 are receivable within the triangular ball cavities 17, thereby allowing the locking bars 4 to move to a radially inner position. Only when the locking bars 4 are moved radially inward may the barrel 5 be rotated, to unlock the lock. This is accomplished by the coded projections 14 having both corner 18 and side 19 ball pockets. If the balls 3 are not all correctly located, then at least one of the coded projections 14 will be obstructed from moving into the respective cavity 17 when it abuts against the misaligned ball 3, ensuring that the locking bar 4 is prevented from moving radially inwards and thus retaining the barrel 5 in a locked position.

As can be seen in FIG. 2 the locking bars 4 are provided with angled surfaces 26 which, in response to a rotational force applied by the user trying to turn the key 25, ride against corresponding angled surfaces of the groove 16 to produce a radially inward force on the locking bar 4. When all the balls 3 are correctly positioned the locking bar 4 is free to move radially inwards under this force and, once the locking bar is clear of groove 16 the barrel 5 is free to turn to an unlocked position. However when the balls 3 are not all correctly positioned, the angled surfaces 26 of the locking bar 4 cannot exit the groove 16 and the barrel 5 is thus prevented from rotating to an unlocked position and therefore remains locked.

Figure 5:
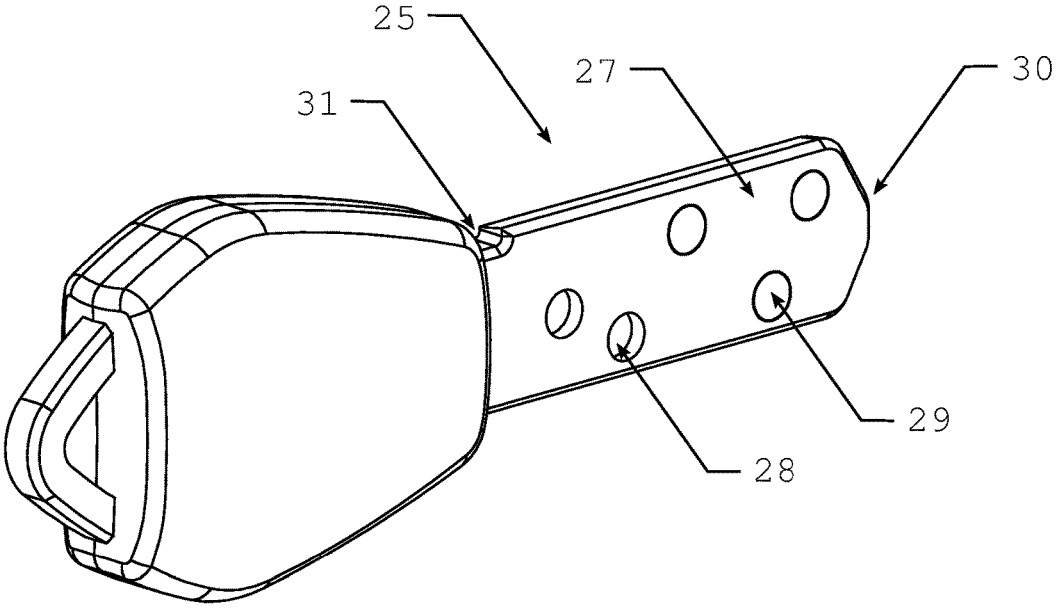
FIG. 5 is a perspective view of a key in accordance with one embodiment of the invention.
Figure 7:
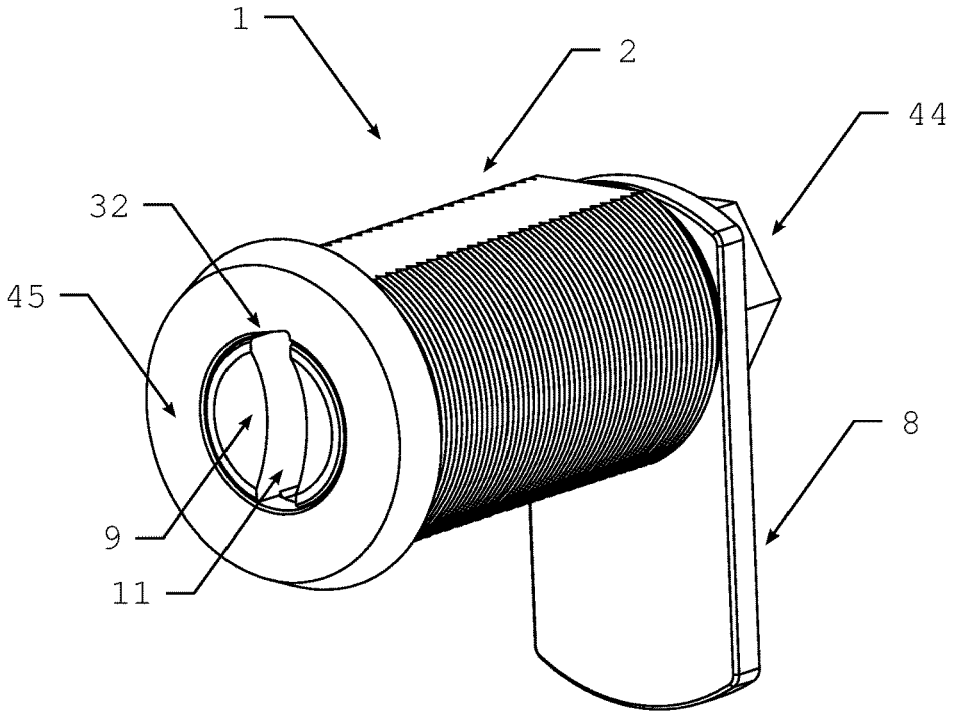
FIG. 7 is a perspective view of the assembled lock of FIGS. 1 to 6.

The key 25 is composed of a key blade 27 as depicted in FIG. 5. The blade 27 contains cavities 28 which are adapted to receive disc shaped magnets 29, being axially magnetized so that an axis of magnetism of each disc extends laterally relative to keyway 11 when the key is inserted. The blade 27 also possesses a leading portion 30 which, in conjunction with the end plug 7, ensures the magnets 29 arrive at a precise location adjacent to the cavities 17 in the extending recesses 13 of the barrel 5. The magnets 29 are generally of a larger diameter than the balls 3, which they attract in axial alignment. Also formed in the key 25 is a notch 31 which during the operation of the lock is designed to engage the rim 32 of the casing 2 (as shown in FIG. 7) to retain the key in the keyway 11, thus providing key retention until the key is rotated back to the original insertion orientation.

FIG. 6 shows that the end plug 7 comprises both a generally disk-shaped head portion 33 and a generally cylindrical threaded portion 34, the threaded portion being of a smaller diameter than the head portion. The head portion 33 includes a pair of opposite flat sections 35 shaped in registration with the recess 36 in the rear end face 12 of the barrel 5, which ensures that the end plug 7 will rotate together with the barrel 5.

The threaded portion 34 of the end plug 7 extends rearwardly from the head portion 33 and is coaxial therewith. The generally cylindrical threaded portion 34 also includes a pair of opposite flat sections 37 which separate the threads 38, such that the end plug 7 has the general appearance of a bolt. Of course there are many other suitable configurations.

In the assembled condition the threaded portion 34 of the end plug 7 is slid through the end cap 39 shown in FIG. 6. The end cap 39 includes an outer threaded surface 40 formed to fit within the inside diameter of the casing 2 and an internal flange 41, sized in registration with the generally cylindrical threaded portion 34 of the end plug 7. Once so positioned, the end cap 39 is threaded on the threaded portion 42 of the case 2, such that the end cap 39 retains the barrel 5 within the casing 2 while permitting the end plug 7 to rotate unimpeded with rotation of the barrel 5.

Finally, the combination of the flat sections 37 and threads 38 of the end plug 7 are adapted to be inserted into an aperture 43 provided in the latch 8 upon assembly of the magnetic lock 1 as shown in FIG. 1. The latch aperture 43 is shaped such that it includes flat sections corresponding to the flat sections 37 of the end plug 7. In this regard, once the threaded portions 34 of the end plug 7 are inserted through the aperture 43 of the latch 8, the latch will rotate together with rotation of the end plug 7. In order to prevent unscrewing of the end cap 39 the flat sections 37 of the end plug 7 are located at a distance from the head portion 33 such that the latch 8 does not directly abut the end cap 39. Additionally, the end cap 39 may be secured to the casing 2 via adhesion, screws or any other suitable fixing mechanism. A nut 44 is provided to hold the latch 8 to the end plug 7, the nut being threaded onto the threads 38 provided on the end plug 7.

FIG. 7 depicts the magnetic lock 1 in the assembled condition. It can be seen that the rim 32 of the casing 2 is adapted to receive the front projection 9 of the barrel 5 to form the front face 45. It will be appreciated that the front face 45 is the portion of the magnetic lock 1 which is visible to the user upon installation of the magnetic lock in the final device, such as a door or padlock. As such, the front projection 9 of the barrel assists the user to locate the key 25 in its operative position.

Figure 8:
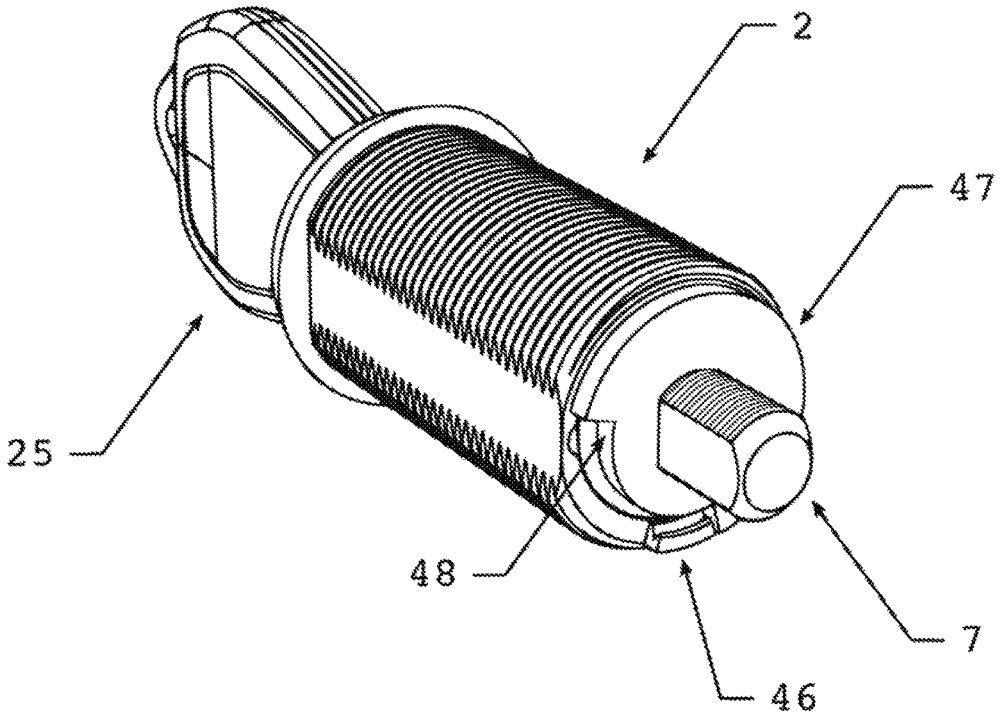
FIG. 8 is a perspective view which depicts a rear projection of the casing in accordance with another embodiment of the invention.

FIG. 8 illustrates another embodiment of the invention comprising a magnetic lock 1 and key 25 of a similar configuration to that previously described. In the embodiment of FIG. 8 the lock 1 is shown with the nut 44 and latch 8 removed and it can be seen that the casing 2 may be formed to include a rear projection 46. The rear projection 46 is configured to interact with a generally circular disc 47 slid onto the end plug 7 between the end cap 39 and latch 8. The disc 47 is configured such that it limits rotation of barrel 5, with rotation of the key 25, to an angle prescribed by the gated portion 48 of the disc 47.

Figure 9:
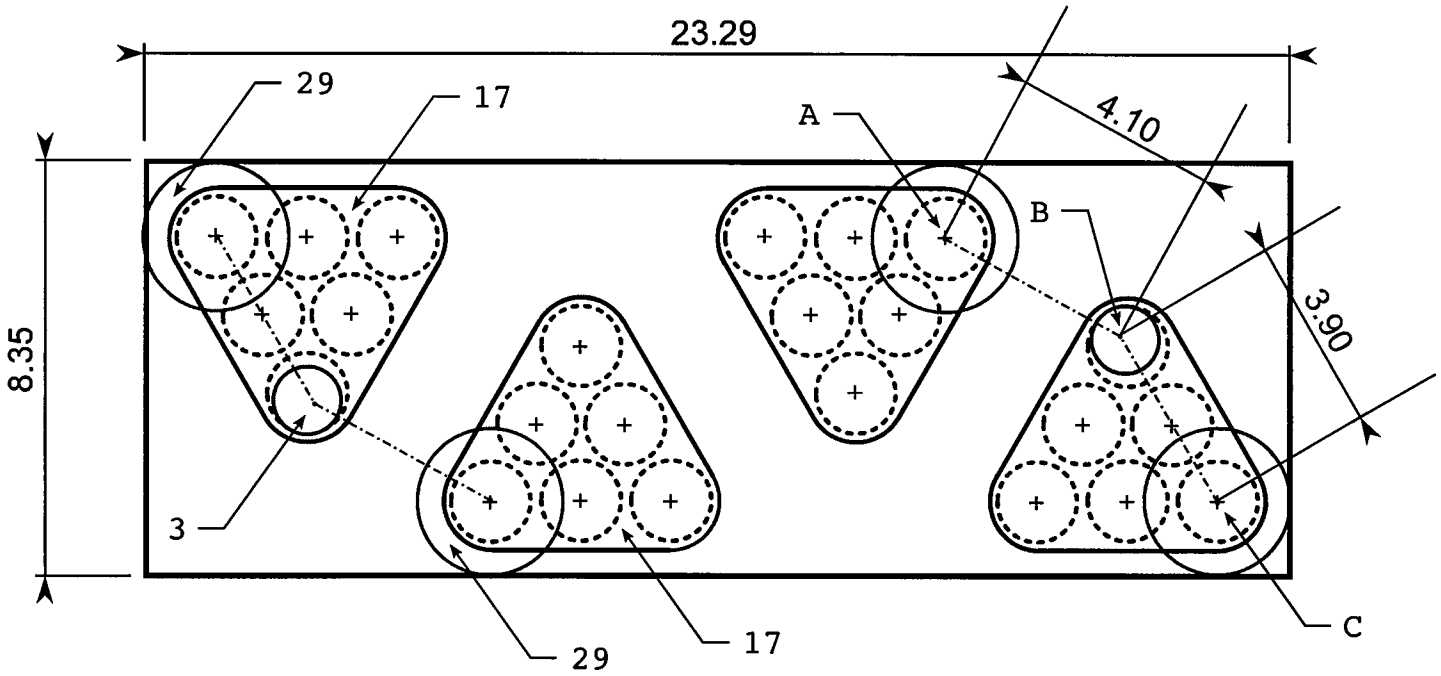
FIG. 9 illustrates an arrangement of locking element cavities in accordance with one embodiment of the invention, comprising four cavities each having six coded positions.

FIG. 9 illustrates another embodiment of the invention in which the ball cavities 17 are provided in another arrangement within the recess 13 of the cylinder 5. In FIGS. 9-13 the ball diameter is 1.45 mm while the key magnet diameter is 3 mm. Providing four cavities in FIG. 9, each with six nominal ball positions, permits approximately 1.7 million permutations. It should also be recognised that the distance between cavities 17 is an important feature that ensures the locking elements, or balls 3, are attracted to the correct key magnets 29. FIG. 9 shows two arrangements of ball cavities 17 and illustrates that the distance between a key magnet 29 and ball 3 for a particular cavity 17 should always be less than distance between that ball 3 and the closest key magnet 29 associated with an adjacent cavity, or it may not locate to the desired coded position. FIG. 9 also shows that the blade of the key needs to be at least 8.35 mm by 23.29 mm in this embodiment, although other embodiments may produce other dimensioning.

Figure 10:
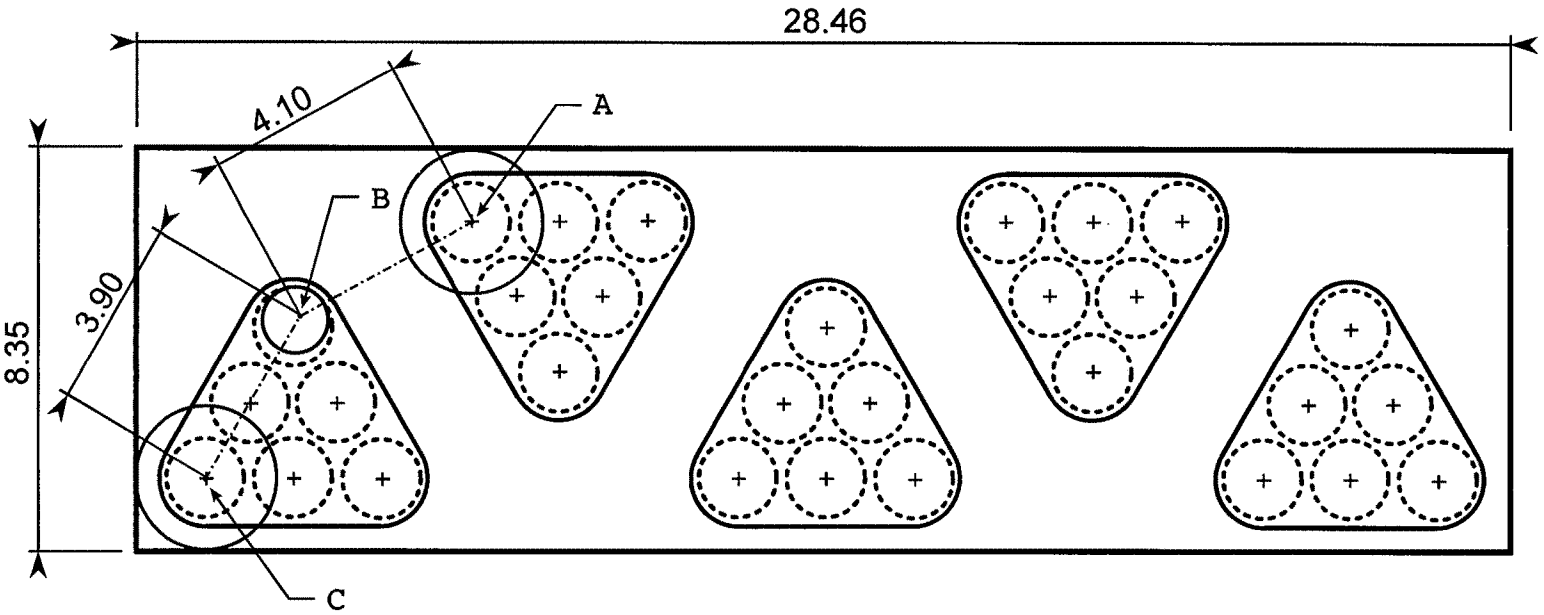
FIG. 10 illustrates an arrangement of locking element cavities in accordance with another embodiment of the invention, comprising five cavities each having six coded positions.
Figure 11:
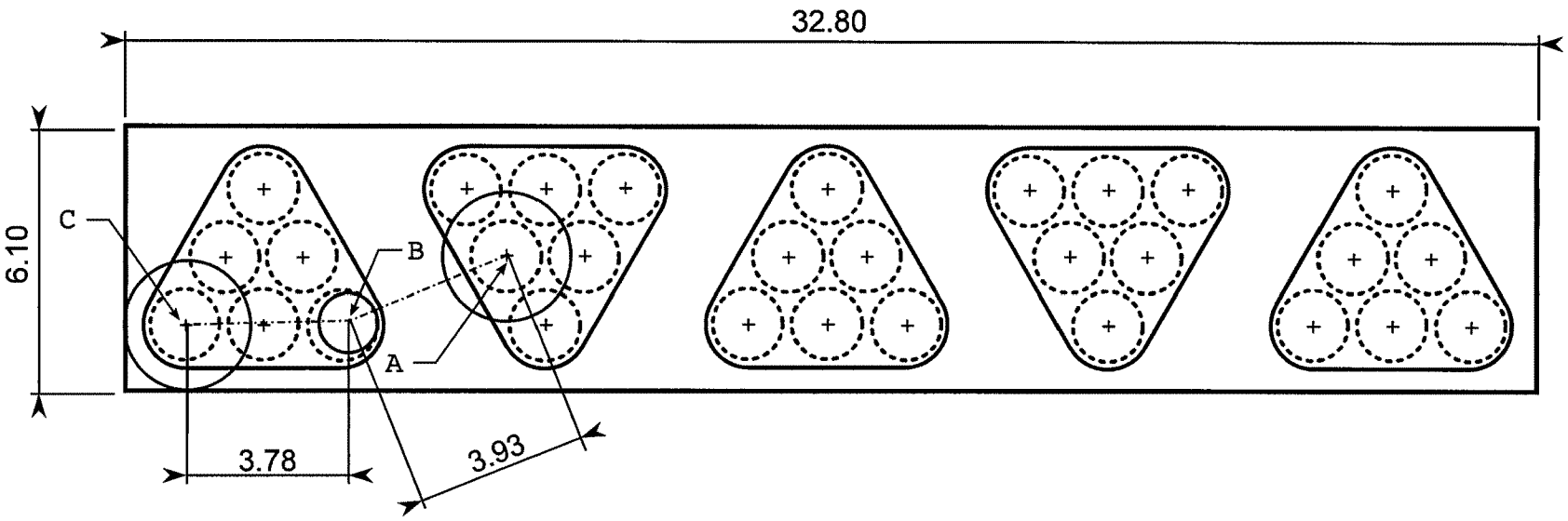
FIG. 11 illustrates an arrangement of locking element cavities in accordance with yet another embodiment of the invention, comprising five cavities each having six coded positions.

FIG. 10 illustrates another embodiment of the invention comprising five cavities 17. Providing five cavities, each with six nominal ball positions, permits approximately 60.4 million permutations. FIG. 10 shows that the key blade must be at least 8.35 mm by 28.46 mm. FIG. 11 illustrates a similar embodiment to FIG. 10, in which the cavities are arranged in a more longitudinal fashion, and in this embodiment the key blade can be 6.10 mm by 32.80 mm.

Figure 12:
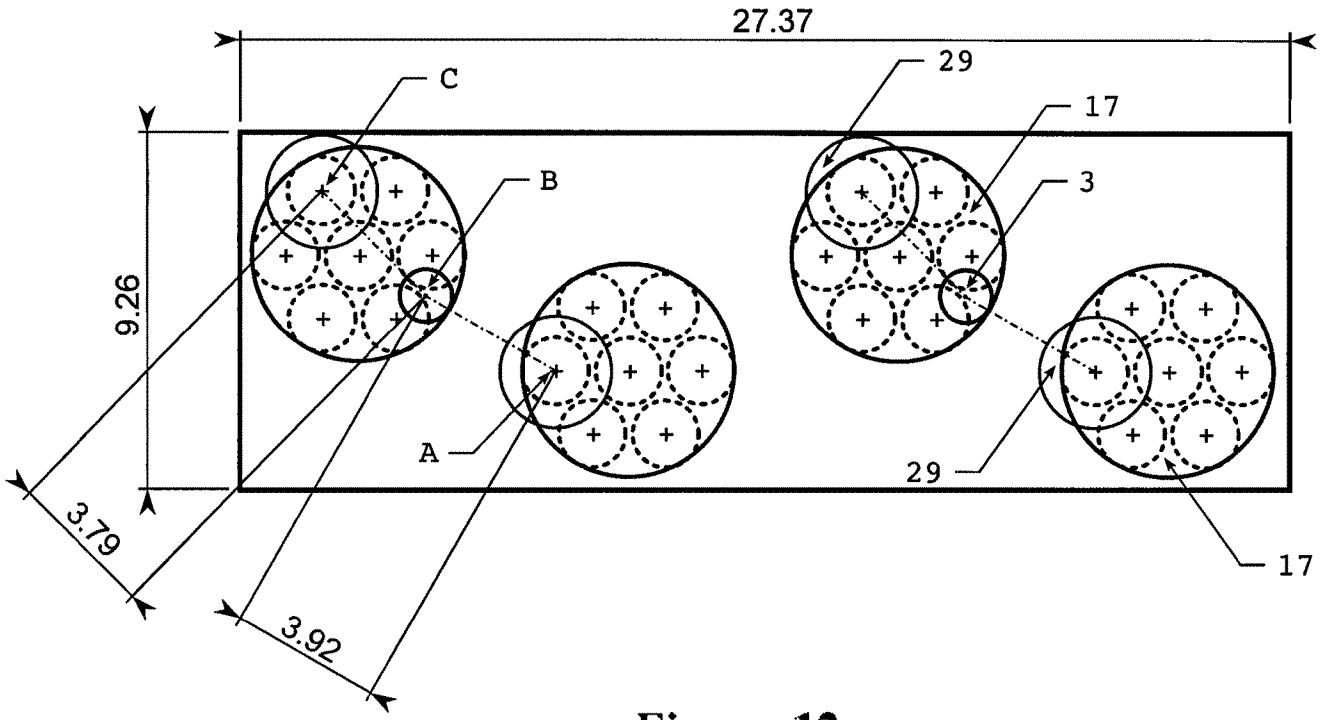
FIG. 12 illustrates an arrangement of locking element cavities in accordance with still another embodiment of the invention, comprising four cavities each having seven coded positions.
Figure 13:
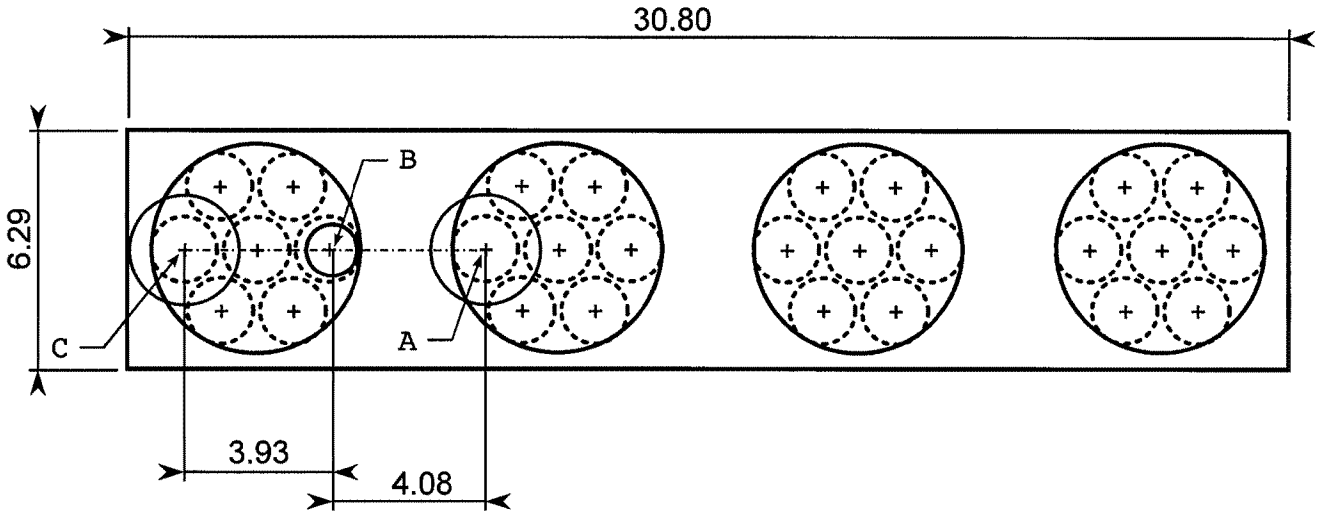
FIG. 13 illustrates an arrangement of locking element cavities in accordance with a further embodiment of the invention, comprising four cavities each having seven coded positions.

FIGS. 12 and 13 illustrate respective embodiments comprising four circular or hexagonal cavities 17, each comprising seven nominal ball positions. Such embodiments permit approximately five million permutations. Throughout FIGS. 9-13, the diagrams show the magnet separation distances when adjacent key magnets (large circles), A, are at their closest to the balls (small circles), B, of a given cavity where the key magnet, C, for that cavity is at the furthest point. It illustrates that the distance BC needs to be less than AB otherwise A will interfere and/or take preference.

Embodiments of the invention may thus provide a lock which can be rotated about any plane or axis, and the balls will not be mislocated within the chamber. Such utility is useful for moveable objects incorporating the lock, such as padlocks.

Some embodiments of the present invention may thus provide a key operable lock mechanism which is highly resistant to manipulation and mechanical malfunction, and may provide such characteristics in a relatively small lock mechanism, such as a camlock, allowing for incorporation into a large range of cylinder formats.

These and/or other embodiments of the invention may provide a lock mechanism that, in addition to the above-mentioned characteristics, is capable of, being manufactured in a simple and economical manner, and functioning in any plane of operation, such as in a padlock or other moveable object.

Although the nominal ball positions are shown in FIGS. 9-13 as being non-overlapping, it is to be noted that alternative embodiments may distinguish one key and lock from another by use of nominal ball positions which are overlapping. Such embodiments may improve the number of lock combinations and/or reduce the required size of the ball cavity, albeit while requiring improved manufacturing and or positioning tolerances to ensure proper registration of the balls with the locking projections.

Some embodiments of the invention may utilise 3D printing for construction of one or more portions of the device. Accordingly, in some embodiments the present invention may reside in a digital blueprint comprising a digital file in a format configured for use with rapid prototyping and computer aided design (CAD) and/or manufacturing, such as being in the STL (stereolithography) file format. Such digital blueprint files, whether produced by performing a three dimensional scan of an embodiment of the invention, or produced by a CAD development software tool, or the like, are within the scope of the present invention.

It will be appreciated by persons skilled in the art that numerous variations and/or modifications may be made to the invention as shown in the specific embodiments without departing from the spirit or scope of the invention as broadly described. For example, the following variations or alterations may arise in other embodiments within the scope of the present invention.

In some embodiments master keying may be effected by providing more than one ball pocket 18, 19 in each locking bar coded projection 14.

In some embodiments the end plug 7 can be affixed in the recess 36 in the rear end face 12 of the barrel 5 by welding or other fixation mechanism, or produced in one piece with the barrel 5.

The key 25 may be provided in two pieces, with magnets 29 located on the inside, to be subsequently joined in order to conceal the location of magnets 29. In this manner the current embodiment may utilise a coating to conceal the location of the magnets 29.

The ball cavities 17 may be provided in any arrangement within the recess 13, including slightly offset positions, although the described embodiment provides a very large number of key combinations within the space provided by conventional lock barrel dimensions. Moreover, the ball cavities 17 may be formed in any suitable shape or combination of shapes.

In other embodiments any suitable number of locking bars 4 may be provided, each travelling radially inwards to effect unlocking. The or each locking bar 4 may in some embodiments be oriented in any suitable manner relative to the radius and circumference of the barrel 5.

The latch 8 and end plug 7 could be configured to trigger any type of locking arrangement such as deadlocks, etc.

In some embodiments the barrel 5 may be retained within the casing 2 without the use of an end cap 39 through a retaining ring which is sprung, or slid, into a groove machined into the rear of the casing 2 and/or barrel 5.

In some embodiments the casing 2 may be formed such that the barrel 5 may be loaded from the front and key retention engaged through a spring loaded ball bearing, or any other suitable mechanism.

The locking bar 4 may be produced in more than one piece and composed of more than one material; the coded projections 14 for example may be composed of polyoxymethylene, or similar material, to frustrate radiographic decoding attacks.

The present embodiments are, therefore, to be considered in all respects as illustrative and not limiting or restrictive.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A lock, comprising:

a barrel defining a keyway, the barrel when rotated unlocking the lock;

a plurality of locking cavities each containing a locking ball which is free to move within a respective locking cavity, and each locking ball being movable in response to a respective local magnetic field applied by a magnetic key when positioned within the keyway, whereby the locking ball may take any one of a number of positions within the respective locking cavity and when in one position the locking ball vacates other possible positions;

a locking bar movable between a first locking bar position in which rotation of the barrel is obstructed by the locking bar, and a second locking bar position in which the barrel is free to rotate, the locking bar comprising coded projections which extend into respective locking cavities when the locking bar moves from the first locking bar position to the second locking bar position; and a code plate shaped in registration with the coded projections of the locking bar such that when the locking bar is in the first locking bar position the code plate and the coded projections of the locking bar form a substantially uninterrupted surface;

wherein the locking balls prevent movement of the locking bar from the first locking bar position to the second locking bar position except when each locking ball has been magnetically moved to a coded position within the respective locking cavity.

2. The lock of claim 1 wherein each locking ball comprises a magnetically susceptible ball.

3. The lock of claim 1 wherein a plurality of locking bars are provided circumferentially about an axis of the barrel, and whereby all locking balls must be unlocked and the locking bars moved radially inward in order to unlock the lock.

4. The lock of claim 1 wherein rotation of the barrel is obstructed by the locking bar while in the first locking bar position by a protrusion of the locking bar engaging in a respective recess positioned in a portion of the lock radially outwards of the locking bar, whereby radially inward movement of the locking bar permits disengagement of the protrusion from the recess.

5. The lock of claim 4 wherein a radially inward force is generated upon the locking bar by providing an angled surface upon the locking bar protrusion, configured to produce a radial force from a rotational force.

6. The lock of claim 1 wherein the locking cavities comprise a substantially triangular shape defining six possible coded positions of the locking ball.

7. The lock of claim 1 wherein the locking bar projections are shaped so as to align with and substantially completely occupy the locking cavities when in the second locking bar position, except in respect of the coded position within each locking cavity which is never occupied by the locking bar projections.

8. The lock of claim 1 wherein master keying is effected by providing more than one ball pocket in each locking bar coded projection.

9. The lock of claim 1 wherein the locking bar is produced in more than one piece.

10. The lock of claim 1 wherein the locking bar is composed of more than one material.

11. The lock of claim 1 wherein the coded projections are composed of polyoxymethylene.

12. A method of operating a lock, the method comprising:

inserting a magnetic key into a keyway defined by a barrel;

the key applying respective local magnetic fields to a plurality of respective locking balls so as to move each locking ball to a coded position within a respective locking cavity, whereby the locking ball may take any one of a number of positions within the respective locking cavity and when in one position the locking ball vacates other possible positions; and applying a rotational force to the key in order to apply a radial force to a locking bar, to move the locking bar from a first locking bar position in which rotation of the barrel is obstructed by the locking bar and in which a code plate shaped in registration with coded projections of the locking bar and the coded projections of the locking bar form a substantially uninterrupted surface, to a second locking bar position in which the barrel is free to rotate, whereby in the second locking bar position coded projections of the locking bar extend into the respective locking cavities.

13. A non-transitory computer readable medium for producing a lock, comprising instructions making up a digital blueprint file which, when executed by one or more processors, causes performance of the following:

three-dimensional printing of a barrel defining a keyway, the barrel when rotated unlocking the lock;

three-dimensional printing of a plurality of locking cavities each configured to contain a locking ball which is free to move within a respective locking cavity, and each locking ball being movable in response to a respective local magnetic field applied by a magnetic key when positioned within the keyway, whereby the locking ball may take any one of a number of positions within the respective locking cavity and when in one position the locking ball vacates other possible positions;

three-dimensional printing of a locking bar movable between a first locking bar position in which rotation of the barrel is obstructed by the locking bar, and a second locking bar position in which the barrel is free to rotate, the locking bar comprising coded projections which extend into respective locking cavities when the locking bar moves from the first locking bar position to the second locking bar position; and three-dimensional printing of a code plate shaped in registration with the coded projections of the locking bar such that when the locking bar is in the first locking bar position the code plate and the coded projections of the locking bar form a substantially uninterrupted surface;

wherein the locking balls prevent movement of the locking bar from the first locking bar position to the second locking bar position except when each locking ball has been magnetically moved to a coded position within the respective locking cavity.

* * * * *